US010011782B2

(12) United States Patent
Koseoglu et al.

(10) Patent No.: US 10,011,782 B2
(45) Date of Patent: Jul. 3, 2018

(54) PROCESS FOR REDUCING THE SULFUR CONTENT FROM OXIDIZED SULFUR-CONTAINING HYDROCARBONS

(71) Applicant: Saudi Arabian Oil Company, Dhahran (SA)

(72) Inventors: Omer Refa Koseoglu, Dhahran (SA); Abdennour Bourane, Ras Tanura (SA); Adnan Al-Hajji, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/041,046

(22) Filed: Sep. 30, 2013

(65) Prior Publication Data

US 2014/0090985 A1 Apr. 3, 2014

Related U.S. Application Data

(60) Provisional application No. 61/707,561, filed on Sep. 28, 2012.

(51) Int. Cl.

| | |
|---|---|
| ***C10G 32/02*** | (2006.01) |
| ***C10G 27/00*** | (2006.01) |
| ***C10G 53/14*** | (2006.01) |
| *C25B 3/04* | (2006.01) |

(52) U.S. Cl.

CPC ..... *C10G 32/02* (2013.01); *C10G 27/00* (2013.01); *C10G 53/14* (2013.01); *C25B 3/04* (2013.01)

(58) Field of Classification Search

CPC ..... C07D 333/76; C25B 1/00
USPC ..... 205/462, 688
See application file for complete search history.

(56) References Cited

U.S. PATENT DOCUMENTS

| | | | | |
|---|---|---|---|---|
| 4,404,069 A * | 9/1983 | Goodin | ..... | C25B 3/04 205/438 |
| 6,087,544 A | 7/2000 | Wittenbrink et al. | | |
| 6,171,478 B1 | 1/2001 | Cabrera et al. | | |
| 6,277,271 B1 | 8/2001 | Kocal | | |

(Continued)

FOREIGN PATENT DOCUMENTS

| | | |
|---|---|---|
| CN | 1517430 A | 8/2004 |
| WO | 218518 A1 | 3/2002 |

(Continued)

OTHER PUBLICATIONS

K. M. Kadish, J. Q. Ding, and T. Malinski, "Resistance of nonaqueous solvent systems containing tetraalkylammonium salts. Evaluation of heterogeneous electron transfer rate constants for the ferrocene/ferrocenium couple" Analytical Chemistry 1984 56 (9), 1741-1744.*

(Continued)

*Primary Examiner* — Harry D Wilkins, III
(74) *Attorney, Agent, or Firm* — Abelman, Frayne & Schwab

(57) ABSTRACT

A process and system for reducing the sulfur content from a mixture of hydrocarbons and oxidized sulfur-containing hydrocarbons is provided by electrochemical decomposition. The electrochemical reactions occur under electrical potential and in the presence of an electrolyte solution that is effective promote decomposition of a portion of the oxidized sulfur compounds, to recover a hydrocarbon product having a reduced sulfur content while minimizing loss of hydrocarbon.

20 Claims, 2 Drawing Sheets

(56) References Cited

U.S. PATENT DOCUMENTS

| | | | | |
|---|---|---|---|---|
| 6,338,788 | B1 * | 1/2002 | Schucker | 205/688 |
| 6,368,495 | B1 | 4/2002 | Kocal et al. | |
| 2005/0150819 | A1 | 7/2005 | Wachs | |
| 2011/0147274 | A1 * | 6/2011 | Soto | B01D 53/96 208/230 |
| 2011/0213187 | A1 | 9/2011 | Al-Shahrani et al. | |
| 2012/0000792 | A1 * | 1/2012 | Greaney | C10G 32/02 205/696 |
| 2013/0015104 | A1 | 1/2013 | Al-Hajji et al. | |

FOREIGN PATENT DOCUMENTS

| | | | |
|---|---|---|---|
| WO | 3014266 | A1 | 2/2003 |
| WO | 2006071793 | A1 | 7/2006 |

OTHER PUBLICATIONS

B Jolivet, D Uguen, "Should anionised benzylic sulfones be considered as carbenoids?", Tetrahedron Letters, vol. 43, Issue 44, Oct. 28, 2002, pp. 7907-7911.*

Ramierez-Verduzco et al. "Desulfurization of diesel by oxidation/extraction scheme: influence of the extraction solvent" Catalysis Today 98 (2004) 289-294.*

Lamm et al, Cathodic Cleavage of Methyl and Benzyl Naphthyl Sulfones, Acta Chemica Scandinavica B, vol. 32, 1978 (no month available), pp. 264-268.*

Simonet, excerpt of Chapter 22 The electrochemical reactivity of sulphones and sulphoxides, from The Chemistry of Sulphones and Sulphoxides, edited by Patai et al,1988 (no month), pp. 1001-1015 (Year: 1988).*

Gonzalez-Perea et al, Dibenzothiophene Sulfone in Sodium Fluoride/Acetonitrile, ECS Transactions vol. 64, No. 34,,from ECS Meeting on Oct. 7, 2014, pp. 21-29 (Year: 2014).*

Lam et al, A review of electrochemical desulfurization technologies for fossil fuels, Fuel Processing Technology, vol. 98, Jun. 2012, pp. 30-38 (Year: 2012).*

Shen et al, Recent advances of sodium borohydride reduction in coal water slurry desulfurization: integration of chemical and electrochemical reduction, RSC Advances, vol. 2, Issue 24, Jun. 2012, pp. 8867-8882 (Year: 2012).*

Srivastava, An evaluation of desulfurization technologies for sulfur removal from liquid fuels, RSC Advances, vol. 2, Issue 3, Dec. 2011, pp. 759-783 (Year: 2011).*

Tang et al, Desulfurization of Kerosene by the Electrochemical Oxidation and Extraction Process, Energy Fuels, vol. 29, No. 4, Mar. 2015, pp. 2097-2103 (Year: 2015).*

Tsyganok et al, Electrocatalytic hydrogenation of aromatic compounds in ionic liquid solutions over WS2-on-glassy carbon and Raney nickel cathodes, Fuel, vol. 93, Mar. 2012, pp. 415-422 (Year: 2012).*

Wang et al, Desulfurization of gasoline by a new method of electrochemical catalytic oxidation, Fuel, vol. 86, No. 17-18, Dec. 2007, pp. 2747-2753 (Year: 2007).*

PCT Application No. PCT/US2013/062558, "International Search Report and Written Opinion," dated Jan. 28, 2014, 10 pages.

Franziska Schoenebeck, et al., "Reductive Cleavage of Sulfones and Sulfonamides by a Neutral Organic Super-Electron-Donor (S.E.D.) Reagent", J.A.C.S., vol. 129, No. 44, 2007, pp. 13368-13369.

Jacques Simonet, et al., "Reactions de coupure des derives sulfones a la cathode de mercure", Bulletin de la Societe Chimique de France, 1971, No. 7, pp. 2754-2760.

B. Jolivet, "Should anionised benzylic sulfones be considered as carbenoids?", Tetrahedron Letters, 43, 2002, pp. 7907-7911.

Leopold Horner, et al., "Hydrierende Spaltung von Sulfonen mit Tetramethylammonium als Elektronenubertrager", Aus dem Institut fur Organische Chemie der Universitat Mainz, Eingegangen am. Oct. 31, 1964, pp. 1715-1721.

Jacques Simonet, et al,, "Electro reduction of substituted amylmethyl sulfones and the corresponding aryl sulfinic acids" (English translation), Bulletin de la Societe Chimique de France, 1971, No. 7, 14 pages.

Leopold Horner, et al., "Hydrogenating Cleavage of Sunfones with Tetramethylammonium as the Electron Carrier" (English translation), Aus dem Institut fur Organische Chemie der Universitat Mainz, Eingegangen am. Oct. 31, 1964, 10 pages.

Office Action from CN 201380062339.8 dated Mar. 9, 2016, and English language translation (11 pages).

* cited by examiner

PROCESS FOR REDUCING THE SULFUR CONTENT FROM OXIDIZED SULFUR-CONTAINING HYDROCARBONS

RELATED APPLICATIONS

This application claims the benefit of U.S. Provisional Patent Application No. 61/707,561 filed Sep. 28, 2012, the disclosure of which is hereby incorporated by reference in its entirety.

BACKGROUND OF THE INVENTION

Field of the Invention

The present invention relates to reducing the sulfur content from oxidized sulfur-containing hydrocarbon compounds, e.g, formed by oxidative desulfurization of sulfur-containing hydrocarbons.

Description of Related Art

Crude oil is the world's main source of hydrocarbons used as fuel and petrochemical feedstock. While compositions of natural petroleum or crude oils are significantly varied, all crudes contain sulfur compounds and most contain nitrogen compounds which may also contain oxygen, but oxygen content of most crude is low. Generally, sulfur concentration in crude is less than about 5 percent, with most crude having sulfur concentrations in the range from about 0.5 to about 1.5 percent. Nitrogen concentration is usually less than 0.2 percent, but it may be as high as 1.6 percent.

Crude oil is refined to produce transportation fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards.

The discharge into the atmosphere of sulfur compounds during processing and end-use of the petroleum products derived from sulfur-containing sour crude oil poses health and environmental problems. The sulfur compounds are converted to sulfur oxides during the combustion process and produce sulfur oxyacids and contribute to particulate emissions.

Oxygenated fuel blending compounds and compounds containing few or no carbon-to-carbon chemical bonds, such as methanol and dimethyl ether, are known to reduce smoke and engine exhaust emissions. However, most of such compounds have high vapor pressure and/or are nearly insoluble in diesel fuel, and they have poor ignition quality, as indicated by their cetane numbers. For instance purified diesel fuels by chemical hydrotreating and hydrogenation to reduce their sulfur and aromatics contents, also causes a reduction in fuel lubricity. Diesel fuels of low lubricity may cause excessive wear of fuel pumps, injectors and other moving parts which come in contact with the fuel under high pressures. Mid distillates, a distillate fraction that nominally boils in the range 180-370° C. are used for fuel or a blending component of fuel for use in compression ignition internal combustion engines (diesel engines). They usually contain from about 1 to 3 percent by weight sulfur. The specification for mid distillate fraction have been reduced to 5-50 part per million weight (ppmw) levels from 3000 ppmw level since 1993 in Europe and United States.

In order to comply with these regulations for ultra-low sulfur content fuels, refiners have to make fuels having even lower sulfur levels at the refinery gate so that they can meet the stringent specifications after blending at the gate. Refiners must choose among the processes or crude oils that provide flexibility that ensures future specifications are met with minimum additional capital investment, in many instances by utilizing existing equipment. Conventional technologies such as hydrocracking and two-stage hydrotreating offer solutions to refiners for the production of clean transportation fuels. These technologies are available and can be applied as new grassroots production facilities are constructed. However, many existing hydroprocessing facilities, such as those using relatively low pressure hydrotreaters, represent a substantial prior investment and were constructed before these more stringent sulfur reduction requirements were enacted. It is very difficult to upgrade existing hydrotreating reactors in these facilities because of the comparatively more severe operational requirements (i.e., higher temperature and pressure) to obtain clean fuel production. Available retrofitting options for refiners include elevation of the hydrogen partial pressure by increasing the recycle gas quality, utilization of more active catalyst compositions, installation of improved reactor components to enhance liquid-solid contact, the increase of reactor volume, and the increase of the feedstock quality.

There are many hydrotreating units installed worldwide producing transportation fuels containing 500-3000 ppmw sulfur. These units were designed for and are being operated at, relatively mild conditions (i.e., low hydrogen partial pressures of 30 kilograms per square centimeter for straight run gas oils boiling in the range of 180° C. to 370° C.).

With the increasing prevalence of more stringent environmental sulfur specifications in transportation fuels mentioned above, the maximum allowable sulfur levels are being reduced to no greater than 15 ppmw, and in some cases no greater than 10 ppmw. This ultra-low level of sulfur in the end product typically requires either construction of new high pressure hydrotreating units or a substantial retrofitting of existing facilities, e.g., by incorporating gas purification systems, reengineering the internal configuration and components of reactors, and/or deployment of more active catalyst compositions.

Sulfur compounds can be classified into four groups according to their hydrodesulfurization reactivity described by the pseudo-first-order rate constants. See, e.g., X. Ma et al., *Ind. Eng. Chem.,* 1994, 33, 218; X. Ma et al., *Ind. Eng. Chem. Res.,* 1995, 34, 748. These groups are:

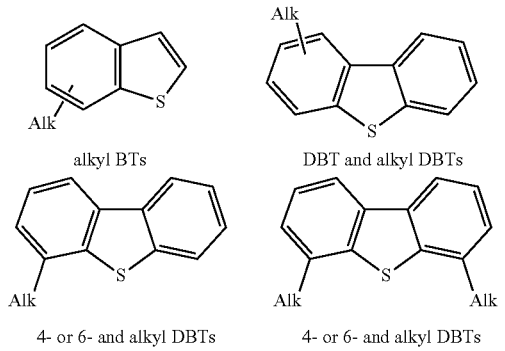

The first group is predominantly alkyl benzothiophenes (BTs); the second, dibenzothiophenes (DBTs) and alkyl DBTs without alkyl substituents at the 4- and 6-positions; the third group, alkyl DBTs with only one alkyl substituent at either the 4- or 6-position; the fourth group, alkyl DBTs with alkyl substituents at the 4- and 6-positions. The relative hydrodesulfurization rate constant for each of the four groups is 36, 8, 3, and 1, respectively.

When the total sulfur content is reduced to 500 ppmw, the main sulfur compounds remaining in the hydrotreated effluent are the third and fourth groups. When the total sulfur content is reduced to 30 ppmw, the sulfur compounds remaining are only the fourth group sulfur compounds, indicating that the lower sulfur content organosulfur compounds have lower hydrodesulfurization reactivity. See D. D. Whitehurst et al., *Catalysis Today,* 1998, 45, 299.

Consequently, these species from the third and fourth groups are referred to as refractory sulfur compounds. Both steric hindrance and electronic density factors contribute to the low reactivity levels of 4- and 6-alkyl substituted DBTs in hydrodesulfurization process. See X. Ma et al. (1995); M. Daage et al., *J. Catal.,* 1994, 194, 414.

The economical removal of refractory sulfur-containing compounds is therefore exceedingly difficult to achieve, and accordingly removal of sulfur-containing compounds in hydrocarbon fuels to an ultra-low sulfur level is very costly by current techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

Compared with conventional catalytic hydrodesulfurization, oxidative desulfurization (ODS) can be performed under mild conditions, i.e., relatively low temperature and under atmospheric pressure conditions. ODS typically uses an oxidizing agent, such as hydrogen peroxide, organic peroxide, peracid, ozone, air and oxygen, in addition to an oxidation catalyst. In the oxidation process, the divalent sulfur atom of refractory sulfur compounds (condensed thiophene) is oxidized by the electrophilic addition reaction of oxygen atoms to form the hexavalent sulfur of sulfones. The chemical and physical properties of sulfones are significantly different from those of the hydrocarbons in fuel oil. Therefore, sulfones can be removed by conventional separation methods such as filtration, solvent extraction and adsorption. An effective ODS process which has been shown to decrease sulfur in transportation fuel from 1100 ppm to 40 ppmw, is described in Al-Shahrani et al. WO/2007/103440 and in Al-Shahrani et al. *Applied Catalysis B*, V. 73, No. 3-4, p. 311 (2007). ODS is considered a promising substitute or supplement to hydrodesulfurization for deep desulfurization of transportation fuels.

The compositions of common sulfides in fuel oil and their respective sulfones are tabulated in Table 1:

TABLE 1

| | DBT | DBT Sulfone ($DBTO_2$) | 4-Methyl DBT (4-MDBT) | 4-Methyl DBT Sulfone (4-$MDBTO_2$) | 4,6-Dimethyl DBT (4,6-DMDBT) | 4,6-Dimethyl DBT Sulfone (4,6-$DMDBTO_2$) |
|---|---|---|---|---|---|---|
| CH % | 82.58 | 72.18 | 83.81 | 72.16 | 84.88 | 73.76 |
| S % | 17.42 | 13.92 | 16.19 | 13.94 | 15.12 | 13.14 |
| O % | 0 | 13.90 | 0 | 13.90 | 0 | 13.10 |

Sulfones formed by ODS of diesel fuels are complex mixtures that vary based on the crude source and other factors, including DBT sulfone along with several alkyl substituted DBT sulfones, such as 4-MDBT sulfone, 4,6-DMDBT sulfone, 1,4-DMDBT sulfone, 1,3-DMDBT sulfone, TriMDBT sulfone, TriEDBT sulfone, and C3DBT sulfone. The structures of certain sulfones found in ODS treated sulfones are given below.

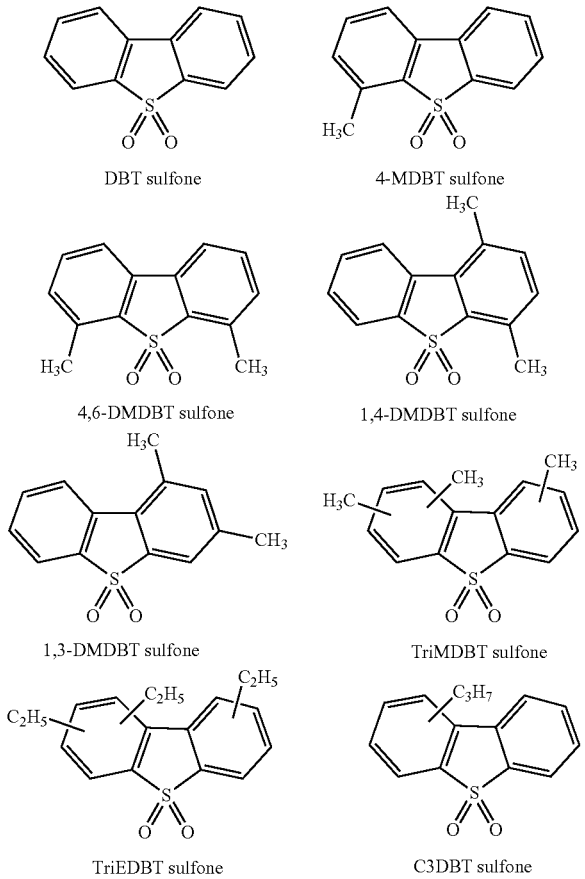

Unlike hydrodesulfurization, in which desulfurized products remain with fuel oil and organic sulfur is converted into gaseous $H_2S$ that leave the product, i.e., fuel oil mixture, oxidation products including sulfones (collectively referred to as "oxidized sulfur-containing hydrocarbons" or "oxidized sulfur-containing hydrocarbon compounds") as formed by ODS remain in the hydrocarbon mixture and must be separated from the product. Various attempts have been made to dispose of oxidized sulfur compounds formed by oxidative desulfurization. These techniques include conventional extraction, distillation and/or adsorption, and conversion in conventional refining processes including delayed coking, FCC, gasification and solvent deasphalting.

In U.S. Pat. No. 6,277,271, incorporated herein by reference, there is disclosed a process for the desulfurization of hydrocarbonaceous oil wherein a stream, composed of hydrocarbonaceous oil and a recycle stream containing oxidized sulfur compounds, is contacted with a hydrodesulfurization catalyst in a hydrodesulfurization reaction zone to obtain low level of sulfur. The resulting hydrocarbonaceous stream is then contacted in its entirety with an oxidizing agent in an oxidation reaction zone to convert the residual sulfur compounds into oxidized sulfur compounds. After decomposing the remaining oxidizing agent, the oxidized sulfur compounds are removed resulting in a stream containing these latter and a stream of hydrocarbonaceous oil having a reduced concentration of oxidized sulfur compounds. At least a portion of the oxidized sulfur compounds are recycled back to the hydrodesulfurization reaction zone to increase the hydrocarbon recovery from the process. However, some of the sulfones compounds formed are reduced back to the initial sulfur compounds still leaving the sulfur disposal problem not fully resolved.

U.S. Pat. No. 6,087,544, incorporated herein by reference, discloses a process to produce distillate fuels having a sulfur level below the distillate feedstream. The distillate feedstream is first fractionated into a light fraction which contains only from about 50 to 100 ppmw of sulfur, and a heavy fraction. The light fraction is then sent to a hydrodesulfurization reaction zone to remove substantially all of the sulfur therein. Finally part of the desulfurized light fraction is then blended with half of the heavy fraction to produce a low sulfur distillate fuel. However, not all the distillate feedstream is recovered to obtain a low sulfur distillate fuel product.

U.S. Pat. No. 6,171,478, incorporated herein by reference, discloses an integrated process in which the hydrocarbonaceous feedstock is first contacted with a hydrodesulfurization catalyst in a hydrodesulfurization reaction zone to reduce the sulfur level to a low sulfur level. The resulting hydrocarbonaceous stream is then sent in its entirety to an oxidation zone containing an oxidizing agent where the residual sulfur is converted into oxidized sulfur compounds under mild conditions. After decomposing the residual remaining oxidizing agent, the oxidized sulfur compounds produced are then extracted using a solvent resulting in a stream containing the oxidized sulfur compounds and a hydrocarbonaceous oils stream having a reduced concentration of oxidized sulfur compounds. A final step of adsorption is carried out on the latter to reach ultra-low sulfur levels.

In WO2002/18518, incorporated herein by reference, a two stage desulfurization process is placed downstream of a hydrotreater. After having been hydrotreated in a hydrodesulfurization reaction zone the entire distillate feedstream is then sent to an oxidation reaction zone to undergo an aqueous formic acid based hydrogen peroxide biphasic oxidation to convert the thiophenic sulfur compounds to the corresponding oxidized compounds, i.e. sulfones. Some of the sulfones end up in the aqueous oxidizing solution during the oxidation reaction and are further removed by a subsequent phase separation step. The oil phase containing the remaining sulfones is finally subjected to a liquid-liquid extraction step. No mention is made about the fate of the sulfones.

WO2003/014266, incorporated herein by reference, discloses a process for the removal of the sulfur from a hydrocarbon stream. The hydrocarbon stream containing the sulfur compounds is sent to an oxidation reaction zone where the organic sulfur compounds are oxidized into the corresponding sulfones using an aqueous oxidizing agent. After separating the aqueous oxidizing agent from the hydrocarbon phase the resulting hydrocarbon stream is sent to the hydrodesulfurization step. The resulting hydrocarbon is substantially sulfur reduced.

WO2006/071793, incorporated herein by reference, discloses a process that reduces the sulfur and/or nitrogen content of a distillate feedstock to produce a transportation fuel or blending components for transportation fuel. The hydrotreated feedstock is contacted with an oxygen-containing gas and a titanium-containing mesoporous oxidation catalyst in an oxidation/adsorption zone to convert the sulfur compounds into the corresponding sulfones that are adsorbed onto the catalyst. No mention is made about the fate of the sulfones.

U.S. Patent Publication No 2005/0150819A1, incorporated herein by reference, discloses a process for removing sulfur compounds found in a hydrocarbon stream. The sulfur compounds are first introduced in a concentration zone for increasing their concentration via e.g. complexation with ammonium complexes, adsorption or extraction and then separated from the sulfur depleted petroleum feedstock. A selective oxidation of the separated sulfur compounds is then performed in the gas phase using air or oxygen in the presence of a supported catalyst into valuable oxygenated products and sulfur deficient hydrocarbons.

In U.S. Pat. No. 6,368,495, incorporated herein by reference, a process effective for the removal of organic sulfur compounds from liquid hydrocarbons is disclosed. The process more specifically addresses the removal of thiophenes and thiophene derivatives from a number of petroleum fractions, including gasoline, diesel fuel, and kerosene. In the first step of the process, the liquid hydrocarbon is subjected to oxidation conditions in order to oxidize at least some of the thiophene compounds to sulfones. Then, these sulfones can be catalytically decomposed to hydrocarbons (e.g. hydroxybiphenyl) and volatile sulfur compounds (e.g. sulfur dioxide). The hydrocarbon decomposition products remain in the treated liquid as valuable blending components, while the volatile sulfur compounds are separable from the treated liquid using well-known techniques such as flash vaporization or distillation.

Other sulfone conversion techniques include those described in US20120055849, US20120055845, US20120055844, US20120055843, which are commonly owned with this application, and describe sulfone conversion by gasification, delayed coking, fluid catalytic cracking (FCC) and solvent deasphalting, respectively. In addition US20130015104, which is also commonly owned with this application, describes sulfone decomposition by super electron donors.

With the steady increase in demand for hydrocarbon fuels having an ultra-low sulfur level, a need exists for an efficient and effective process and apparatus for desulfurization while maximizing product yield.

Accordingly, it is an object of the present invention to effectively reducing the concentration of oxidized sulfur compounds from a mixture of liquid hydrocarbons and the oxidized sulfur-containing hydrocarbon compounds while minimizing loss of hydrocarbon.

SUMMARY OF THE INVENTION

In accordance with one or more embodiments, the invention relates to a system and method for reducing the sulfur content from a mixture of hydrocarbons and oxidized sulfur-containing hydrocarbon compounds while minimizing loss of hydrocarbon product, wherein the oxidized sulfur-containing hydrocarbon compounds can be formed via an upstream oxidative desulfurization process.

In accordance with one embodiment, a process for reducing sulfur content from a mixture of hydrocarbons and oxidized sulfur-containing hydrocarbon compounds is provided. The mixture or the portion containing oxidized sulfur-containing hydrocarbon compounds is subjected to an electrochemical decomposition process using an applied electric potential across paired electrodes. The electrochemical reactions occur in the presence of an electrolyte solution which is effective to promote the decomposition of a portion of the oxidized sulfur-containing hydrocarbon compounds. Accordingly, hydrocarbon product is recovered having reduced sulfur content while overall loss of hydrocarbon compounds is minimized.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The foregoing summary as well as the following detailed description of preferred embodiments of the invention will be best understood when read in conjunction with the attached drawings. For the purpose of illustrating the invention, there are shown in the embodiments which are presently preferred. It should be understood, however, that the invention is not limited to the precise arrangements and apparatus shown. In the drawings the same or similar reference numerals are used to refer to the same or similar elements, in which.

DETAILED DESCRIPTION OF THE INVENTION

The present process is concerned with reducing the concentration of oxidized sulfur-containing hydrocarbon compounds from a mixture of liquid hydrocarbons and oxidized sulfur-containing hydrocarbon, typically resulting from oxidative desulfurization of liquid hydrocarbons. In general, the oxidized sulfur-containing hydrocarbon are admixed with an electrolyte composition and subjected to an applied electric potential and under conditions effective to decompose intermediate products from an oxidative desulfurization process.

Figure 1:
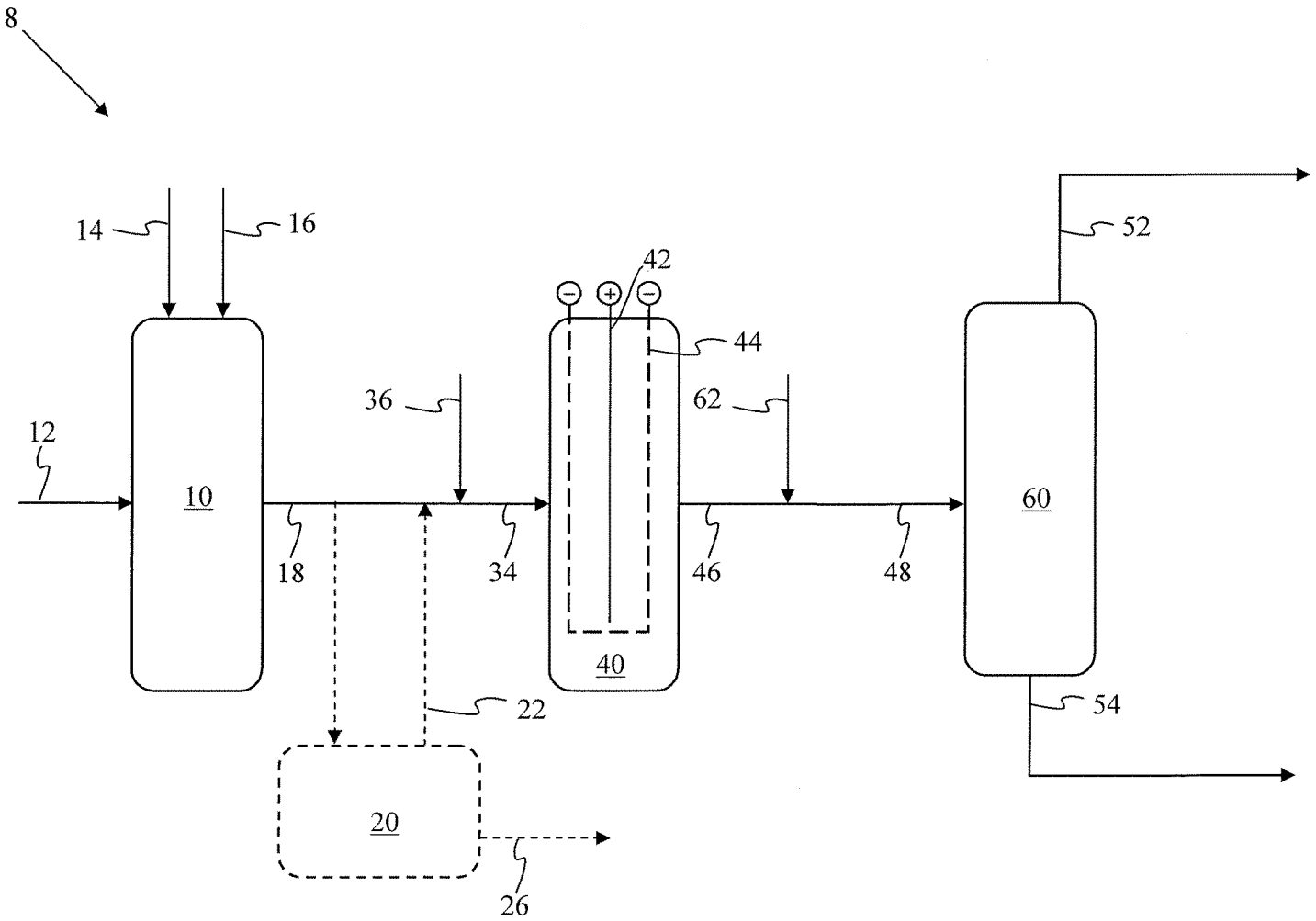
FIG. 1 is a schematic process flow diagram of an integrated desulfurization system and process for removal of oxidized sulfur-containing hydrocarbon compounds formed by oxidative desulfurization.

FIG. 1 is a schematic process flow diagram of an integrated system 8 for carrying out oxidative desulfurization of a hydrocarbon feed and electrochemical decomposition of the oxidized sulfur-containing hydrocarbon intermediate products, including sulfones. Apparatus 8 generally includes an oxidative desulfurization zone 10 to convert sulfur-containing hydrocarbons to oxidized sulfur-containing hydrocarbons, an electrochemical reaction zone 40 to decompose oxidized sulfur-containing hydrocarbons, and a separation zone 60 for recovery of hydrocarbon product and removal of electrolyte and sulfur compounds derived from the oxidized sulfur-containing hydrocarbons.

Oxidative desulfurization zone 10 generally includes a feed inlet for receiving a hydrocarbon feed 12 to be desulfurized, one or more inlets for receiving an oxidizing agent 14 and an oxidizing catalyst 16, and an oxidized effluent outlet for discharging the mixture 18 of desulfurized hydrocarbons and oxidized sulfur-containing hydrocarbon compounds. Note that while separate streams are shown for the oxidant and catalyst that are introduced to the oxidative desulfurization zone 10, a person having ordinary skill in the art will appreciate that these can be combined as a single stream to the oxidative desulfurization zone 10 and/or combined with the feed 12 prior to introduction into the oxidative desulfurization zone 10.

The electrochemical reaction zone 40 generally includes an inlet in fluid communication with the source of a mixture 34 of the oxidized sulfur-containing hydrocarbons 18 (directly or after an optional intermediate step to recover desulfurized hydrocarbons described further herein) and electrolyte solution 36, and an outlet for discharging an intermediate hydrocarbon mixture 46 containing desulfurized hydrocarbons, electrolyte and sulfur compounds.

Separation zone 60 generally includes an inlet in fluid communication with electrochemical reaction zone 40 to receive intermediate hydrocarbon products 46, an outlet for discharging a mixture 54 of electrolyte solution and sulfur byproducts, and an outlet for recovering the desulfurized hydrocarbon product 52. In certain embodiments electrolyte solution can be recycled from stream 54 after removal of water and sulfur byproducts (not shown).

In an integrated process carried out using system 8 described with respect to FIG. 1, a hydrocarbon feedstock 12, along with effective quantities of oxidizing agent and oxidizing catalyst, is introduced to the oxidative desulfurization zone 10 operating under conditions which facilitate oxidative desulfurization reactions, i.e., conversion of sulfur-containing hydrocarbon compounds into their respective oxides, including sulfones and sulfoxides. In certain embodiments the oxidizing agent, oxidizing catalyst and/or operating conditions are tailored to promote sulfone formation.

The effluent of oxidative desulfurization zone 10, mixture 18 containing desulfurized hydrocarbons and oxidized sulfur-containing hydrocarbon compounds, is discharged and combined with an electrolyte solution 36 conveyed, and the resulting mixture 34 is conveyed to the electrochemical reaction zone 40. In certain embodiments, the mixture 18 can be subjected to extraction in an extractor 20 to recover desulfurized hydrocarbon products 26 and concentrate the oxidized sulfur-containing hydrocarbon compounds in a stream 22, which is mixed with the electrolyte solution 36.

The hydrocarbon stream that is subjected to oxidative desulfurization can be derived from naturally occurring fossil fuels such as crude oil, shale oils, coal liquids, intermediate refinery products or their distillation fractions such as naphtha, gas oil, vacuum gas oil or vacuum residue or combination thereof. A suitable feedstock can be characterized by a boiling point within the range of about 150° C. to about 1500° C., although one of ordinary skill in the art will appreciated that certain other hydrocarbon streams can benefit from the practice of the system and method described herein.

The hydrocarbon feedstream subjected to oxidation in oxidative desulfurization zone can also be an effluent from a hydrodesulfurization zone. In such case, the oxidized effluent from the oxidative desulfurization zone can be fractioned to remove the portion not containing oxidation products, e.g., a fraction boiling below cut point in the range of about 320-360° C., thereby reducing the requisite flow capacity of the electrochemical reactor. In such systems, the feed can be contacted with a hydrodesulfurization catalyst in a hydrodesulfurization reaction zone, for instance, under mild conditions (e.g., 20-40 kg/cm$^2$ hydrogen partial pressure, 300-360° C. and a liquid hourly space velocity of 1-8 h$^{-1}$) to reduce the sulfur level to a relatively low level (e.g., 500-3000 ppmw). The hydrotreated feedstock is then contacted with an oxidizing agent and a catalyst in the oxidation reaction zone under mild conditions to convert the sulfur-containing hydrocarbons into their oxidation products.

The oxidizing agent for use during oxidative desulfurization can be selected from liquid hydrogen peroxide and organic peroxides selected from the group consisting of alkyl or aryl hydroperoxides and dialkyl and diaryl peroxides, wherein the alkyl and aryl groups of the respective dialkyl and diaryl peroxides are the same or different. An effective quantity of oxidizing agent is used, which varies with the selected compound(s). For instance, a molar ratio of hydrogen peroxide-to-sulfur is typically at least 4:1 to effectively oxidize organosulfur compounds into their respective oxidized sulfur compounds. In certain embodiment, the quantity of oxidizing agent is selected so that the respective oxidized sulfur compounds are primarily sulfones. Gaseous oxidants, such as air, oxygen, or nitrous oxide can also be used in certain embodiments.

The oxidation catalysts can be homogeneous transition metal catalysts, active species of Mo(VI), W(VI), V(V), Ti(IV), or a combination thereof possessing high Lewis acidity with weak oxidation potential. For homogeneous catalysts, metal salts are dissolved in aqueous solutions and added to the reactant mixture in solution as catalyst.

In embodiments using liquid oxidants, the oxidative desulfurization zone 10 can operate at atmospheric pressure, and at a temperature in the range of from about 80-140° C. and in certain embodiments 80-100° C. In embodiments using gaseous oxidant the oxidative desulfurization zone 10 can operate at a pressure range of from about 10-100 kg/cm$^2$, in certain embodiments of from about 10-50 kg/cm$^2$ and in further embodiments of from about 10-30 kg/cm$^2$, and a temperature in the range of from about 250-350° C.

The electrochemical reactor 40 can be in any suitable configuration that promotes for electrochemical decomposition of oxidized sulfur-containing hydrocarbons. For instance, FIG. 1 shows a schematic of an electrochemical reactor 40 which includes an anode 42 and one or more cathodes 44 to which are applied a source of DC current (not shown). The design of the reactor vessel 40 and the electrodes 42, 44 provide for intimate contact between the moving solution from stream 34, containing the oxidized sulfur-containing hydrocarbons and the electrolyte solution, and the electrode surface, so as to promote the reactions that lead to decomposition of the oxidized sulfur-containing hydrocarbons into sulfur-free hydrocarbons and sulfur byproducts. While not wishing to be bound by theory, it is believed that the sulfur compounds in the oxidized sulfur-containing hydrocarbons form salts that are removed in the separation zone 60.

In general, the cathode(s) 44 of the electrochemical cell reactor 40 are formed of a material selected from the group consisting of platinum, stainless steel and graphite. Anode(s) 42 of the electrochemical cell reactor 40 are formed of a suitable material selected from the group consisting of platinum, stainless steel, nickel and graphite. The cathode and anode are connected to a suitable voltage source that applies a current across the electrodes. The overall cell potential of the electrochemical reactor can be about 1.0 to about 2.5 V (measured against an Ag/AgCl reference electrode.)

The electrochemical reactor can operate at a reaction temperature of from about 20° C. to about 350° C., a reaction pressure of from about 3 kg/cm$^2$ to about 30 kg/cm$^2$, and a liquid hourly space velocity of from about 0.05 h$^{-1}$ to about 4.0 h$^{-1}$.

The oxidized sulfur-containing hydrocarbons are converted in the electrochemical reactor, under the applied electric potential and in the presence of an electrolyte solution including electrolyte and solvent, into desulfurized hydrocarbons and sulfur compounds that are in an aqueous phase and removed in the separation zone 60. Organic solvents effective for the process herein can be selected from the group consisting of ethylene carbonate, propylene carbonate, nitrobenzene, benzonitrile, N-formyl morpholine, sulfolane and mixtures including at least one of the foregoing solvents. Solvents vary by chemical type, polarity, efficacy and stability, and persons of ordinary skill in the art can readily establish the useful and effective ratios of solvent for a given feedstream and sulfur speciation.

Suitable electrolytes effective for the process herein include tetraalkylammonium salts selected from the group consisting of such as tetra-ethylammonium perchlorate, tetrabutylammonium perchlorate, tetraethyl-ammonium tetrafluoroborate, tetrabutylammonium tetrafluoroborate, tetraethyl-ammonium hexafluorophosphate, tetrabutylammonium hexafluorophosphate, tetraethylammonium paratoluene sulfonate, tetrabutylammonium chloride, tetrabutylammonium bromide and mixtures including at least one of the foregoing salts. These electrolytes are present in an effective concentration, which can be measured based on the solubility of the selected electrolyte in the selected solvent. In general, the electrolytes are soluble in the organic solvent to a concentration of at least about 0.05 molar, in certain embodiments at least about 0.1 molar and in further embodiments at least about 0.5 molar.

There is no catalyst required for the electrochemical decomposition reactions of oxides of sulfur compounds.

The electrochemical reaction effluents 46 are separated in the separation zone 60. Water 62 is added to the reaction effluent to remove the sulfur compounds and electrolyte components in salt form. Separation zone 60 generally operations as a phase separator in which an aqueous phase 54 includes electrolyte salts and decomposed sulfur byproducts, and an oil phase 52 includes the desulfurized hydrocarbon product and a minor amount of the solvent or electrolyte solution.

Figure 2:
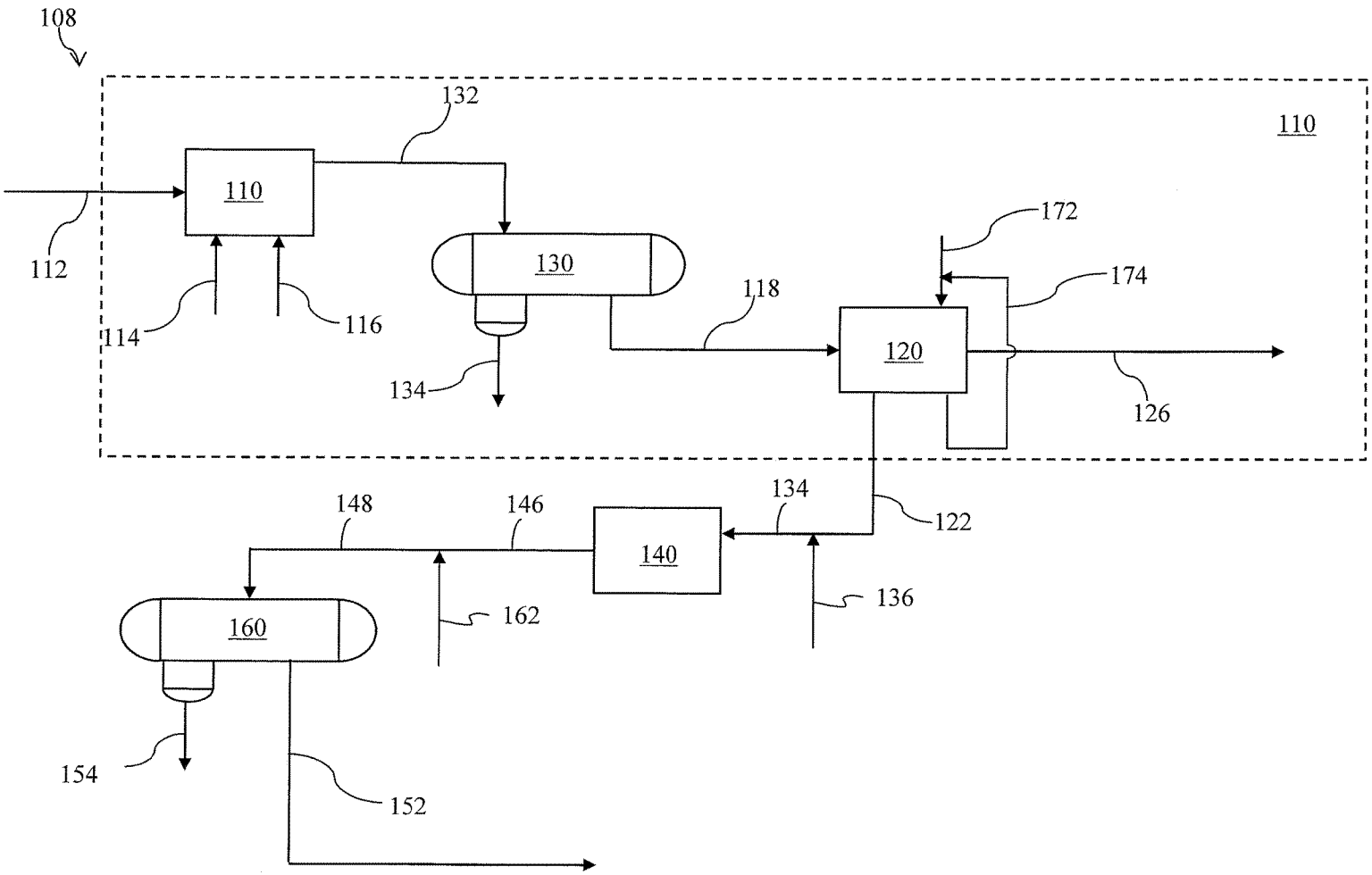
FIG. 2 is a schematic process flow diagram of another embodiment of an integrated desulfurization system and process for removal of oxidized sulfur-containing hydrocarbon compounds formed by oxidative desulfurization.

FIG. 2 shows a process similar to that of FIG. 1 with an extraction zone 120 for recovery of desulfurized product prior to electrochemical reaction for sulfone decomposition, and a separation zone 130 for removal of aqueous salt solutions derived from a homogeneous catalyst used in aqueous phase in the oxidative desulfurization process. In an integrated process carried out using system 108 shown with respect to FIG. 2, a hydrocarbon feedstock 112, along with effective quantities of oxidizing agent 114 and aqueous phase homogeneous oxidizing catalyst 116, is introduced to the oxidative desulfurization zone 110. The effluent of oxidative desulfurization zone 110, mixture 132 containing desulfurized hydrocarbons, oxidized sulfur-containing hydrocarbon compounds and an aqueous phase, is passed to a separator 130 for removal of an aqueous phase 134 and recovery of a non-aqueous oil phase 118, a mixture containing desulfurized hydrocarbons and oxidized sulfur-containing hydrocarbon compounds.

The non-aqueous oxidized effluent 118 is supplied to the extraction vessel 120 where it is contacted with a stream of recycled extraction solvent 174 and make-up extraction solvent 172. The extraction solvent can be a polar solvent, and in certain embodiments, can have a Hildebrandt solubility value of greater than about 19. In certain embodiments, when selecting the particular polar solvent for use in extracting oxidized sulfur and nitrogen containing species, selection may be based upon, in part, solvent density, boiling point, freezing point, viscosity, and surface tension. Exemplary polar solvents suitable for use in the extraction step can include acetone (Hildebrand value of 19.7), carbon disulfide (20.5), pyridine (21.7), dimethyl sulfoxide (DMSO) (26.4), n-propanol (24.9), ethanol (26.2), n-butyl alcohol (28.7), propylene glycol (30.7), ethylene glycol (34.9), dimethylformamide (DMF) (24.7), acetonitrile (30), methanol (29.7), and the like. In certain embodiments, acetonitrile and methanol, due to their low cost, volatility, and polarity, are preferred. In certain embodiments, solvents that include sulfur, nitrogen, or phosphorous, preferably have a relatively high volatility to ensure adequate stripping of the solvent from the hydrocarbon feedstock. Extraction zone 120 can be operated at a temperature of between about 20° C. and 60° C., in certain embodiments between about 25° C. and 45° C., and in further embodiments between about 25° C. and 35° C. Extraction zone 120 can operate at a pressure of between about 1 and 10 bars, in certain embodiments between about 1 and 5 bars, and in further embodiments between about 1 and 2 bars. In certain embodiments, extraction zone 120 operates at a pressure of between about 2 and 6 bars. The ratio of the extraction solvent to non-aqueous oxidized effluent 118 can be between about 1:3 and 3:1, in certain embodiments between about 1:2 and 2:1, and in further embodiments about 1:1. Contact time between the extraction solvent and non-aqueous oxidized effluent 118 can be between about 1 second and 60 minutes, in certain embodiments less than about 15 minutes. In certain embodiments, extraction zone 120 can include various means for increasing the contact time between the extraction solvent and the non-aqueous oxidized effluent 118, or for increasing the degree of mixing of the two solvents. Means for mixing can include mechanical stirrers, agitators, trays, or like means.

A desulfurized hydrocarbon product 126 and a stream of sulfones and sulfoxides 122 are produced from the extraction zone 120. While the desulfurized hydrocarbon product 126 is recovered the sulfones and sulfoxides stream 122 is admixed with electrolyte solution 136 and the mixture is conveyed to the electrochemical reaction zone 140. As described with respect to FIG. 1 oxidized sulfur-containing hydrocarbons are converted in the electrochemical reactor, under the applied electric potential and in the presence of an electrolyte solution including electrolyte and solvent, into desulfurized hydrocarbons and sulfur compounds that are in an aqueous phase.

Upon completion of sulfone decomposition in electrochemical reaction zone 140, a desulfurized effluent 146 exits therefrom and is mixed with water stream 162 and sent to the separation zone 160 to remove reaction by-products with a stream of salt, resulting in a water/salt stream 154 including electrolyte and sulfur byproducts. A stream of recovered desulfurized hydrocarbons 152 is recovered.

In further embodiments, an adsorption zone (not shown) can be incorporated in fluid communication with the desulfurized hydrocarbon 126 and/or 152 for further desulfurization. Exemplary adsorbents can include activated carbon, silica gel, alumina, natural clays and other inorganic adsorbents. It can also include polar polymers that have been applied to silica gel, activated carbon and alumina. The adsorption zone can be a column operated at effective temperature and pressure ranges, and adsorbent to oil ratios, to achieve the desired degree of final desulfurization.

Accordingly, a system and process is described herein which is capable of efficiently and cost-effectively reducing the sulfur content of hydrocarbon fuels while minimizing loss of hydrocarbons. Deep desulfurization of hydrocarbon fuels according to the present process effectively optimizes use of integrated apparatus and processes, combining oxidative desulfurization and sulfone electrochemical decomposition. Using the system and process of the present invention, refiners can incorporate oxidative desulfurization into sulfur removal schemes, and existing hydrodesulfurization equipment can be used and run under relatively mild operating conditions. Accordingly hydrocarbon fuels can be economically desulfurized to an ultra-low level and hydrocarbon product recovery can be maximized since a portion of organosulfur compounds are converted to sulfur-free hydrocarbons and separable sulfur byproducts.

EXAMPLE

A hydrotreated straight run diesel containing 500 ppmw of elemental sulfur 0.28 W % of organic sulfur density of 0.85 Kg/L was subjected to oxidative desulfurization under the following reaction conditions: oxidant (Hydrogen peroxide) to sulfur molar ration of 4:1; Mo(IV) oxidation catalyst; a reaction time of 30 minutes; and reaction temperature of 80° C.; and a reaction pressure of 1 Kg/cm$^2$.

The below mass balance tables show reference number streams corresponding with the schematic process flow diagram in FIG. 2, and do not include the non-reactive components to the electrochemical reaction zone, electrolyte and solvent.

TABLE 2

Oxidative Desulfurization

| Stream Name | | Diesel | Oxidant | Catalyst | Catalyst | Diesel Oxidized |
|---|---|---|---|---|---|---|
| Stream Type | | Feed | Oxidant | Catalyst | Waste | Product |
| Stream | Unit | 112 | 114 | 116 | 134 | 118 |
| Phase | | Oil | Aqueous | Aqueous | Aqueous | Oil |
| Diesel | Kg | 1000 | | | 3 | 995 |
| Diesel Reject | Kg | | | | | |
| Acetic Acid | Kg | | 0 | 136 | 34 | 86 |
| $H_2O_2$ | Kg | | 2 | 0 | | |
| $H_2O$ | Kg | 0 | 4 | 4 | 3 | 0 |
| $Na_2WO_4$ | Kg | | 1 | 1 | 1 | |
| Total | Kg | 1000 | 6 | 141 | 41 | 1082 |

TABLE 3

| Extraction | | | | | |
|---|---|---|---|---|---|
| Stream Name | | Diesel Oxidized | CH3OH | Desulfurized Oil | Sulfones |
| Stream Type | | Feed | Solvent | Product | Product |
| Stream | Unit | 118 | 172 | 126 | 122 |
| Phase | | Oil | Solvent | Oil | Oil |
| Diesel | Kg | 995 | | 879 | |
| Diesel Reject | Kg | | | | 93 |
| Acetic Acid | Kg | 86 | | | |
| $H_2O_2$ | Kg | | | | |
| $H_2O$ | Kg | 0 | | 0 | |
| $Na_2WO_4$ | Kg | | | | |
| Methanol | Kg | | 1082 | 7 | |
| Total | Kg | 1082 | 1082 | 886 | 93 |

TABLE 4

| Sulfone Decomposition | | | |
|---|---|---|---|
| Stream Name | | Sulfones | Recovered Hydrocarbons |
| Stream Type | | Feed | Product |
| Stream | Unit | 122 | 152 |
| Phase | | | Oil |
| Sulfones | Kg | 93 | |
| Recovered Hydrocarbons | Kg | | 87 |
| Total | Kg | 93 | 87 |

The method and system of the present invention have been described above and in the attached drawings; however, modifications will be apparent to those of ordinary skill in the art and the scope of protection for the invention is to be defined by the claims that follow.

The invention claimed is:

1. A process for reducing the sulfur content from an oxidation reactor effluent including a mixture of liquid hydrocarbons and oxidized sulfur-containing hydrocarbon compounds, the process comprising:

electrochemically reacting the oxidation reactor effluent in an electrochemical reactor in the presence of an effective amount of electrolyte solution, the electrochemical reaction occurring under an electrical potential effective to promote decomposition of at least a portion of the oxidized sulfur-containing hydrocarbon compounds into a mixture of sulfur-free hydrocarbons and sulfur byproducts, mixing the mixture of sulfur-free hydrocarbons and sulfur byproducts with water; and separating the mixture of sulfur-free hydrocarbons and sulfur byproducts into sulfur-free hydrocarbons and a water/salt stream containing sulfur byproduct, wherein the electrochemical reaction occurs at a temperature from about 20° C. to about 350° C., at a pressure of about 3 $kg/cm^2$ to about 30 $kg/cm^2$, and at a liquid hourly space velocity of about 0.05 $h^{-1}$ to about 4.0 $h^{-1}$, wherein the electrolyte solution comprises an electrolyte salt in an organic solvent, and wherein the organic solvent is selected from the group consisting of ethylene carbonate, propylene carbonate, nitrobenzene, benzonitrile, N-formyl morpholine, sulfolane and mixtures including at least one of the foregoing solvents.

2. The process according to claim 1 wherein the mixture of sulfur-free hydrocarbons and sulfur byproducts further comprises electrolyte and wherein the water/salt stream further contains electrolyte.

3. The process according to claim 1, wherein the overall cell potential of the electrochemical reactor is generally about 1.0 to about 2.5 V as measured against an Ag/AgCl reference electrode.

4. The process according to claim 3, wherein the electrochemical reactor comprises cathode(s) formed of a material selected from the group consisting of platinum, stainless steel and graphite and anode(s) formed of a material selected from the group consisting of platinum, stainless steel, nickel and graphite.

5. The process according to claim 1 wherein the electrolyte salt is a tetraalkylammonium salt.

6. The process according to claim 5 wherein the tetraalkylammonium salt is selected from the group consisting of tetra-ethylammonium perchlorate, tetrabutylammonium perchlorate, tetraethyl-ammonium tetrafluoroborate, tetrabutylammonium tetrafluoroborate, tetraethyl-ammonium hexafluorophosphate, tetrabutylammonium hexafluorophosphate, tetraethylammonium paratoluene sulfonate, tetrabutylammonium chloride, tetrabutylammonium bromide and mixtures including at least one of the foregoing salts.

7. The process according to claim 5 wherein the tetraalkylammonium salt is present in the organic solvent in a concentration of at least about 0.05 molar.

8. The process according to claim 5 wherein the tetraalkylammonium salt is present in the organic solvent in a concentration of at least about 0.1 molar.

9. The process according to claim 5 wherein the tetraalkylammonium salt is present in the organic solvent in a concentration of at least about 0.5 molar.

10. The process as in claim 1, wherein the oxidized sulfur-containing hydrocarbon compounds include sulfones and/or sulfoxides.

11. The process according to claim 1, wherein the oxidized sulfur-containing hydrocarbon compounds is derived from a gasoline, diesel fuel, or kerosene fraction.

12. The process according to claim 1, wherein the oxidized sulfur-containing hydrocarbon compounds include DBT sulfone and one or more alkyl substituted DBT sulfones selected from 4-MDBT sulfone, 4,6-DMDBT sulfone, 1,4-DMDBT sulfone, 1,3-DMDBT sulfone, TriMDBT sulfone, TriEDBT sulfone, or C3DBT sulfone.

13. The process according to claim 1, wherein the oxidation reactor effluent is from an oxidation process of a feedstock derived from naturally occurring fossil fuels such as crude oil, shale oils, coal liquids, intermediate refinery products or their distillation fractions such as naphtha, gas oil, vacuum gas oil or vacuum residue or combination thereof.

14. The process according to claim 1, wherein the oxidation reactor effluent is from an oxidation process of a hydrodesulfurization zone effluent boiling above a cut point in the range of from 320-360° C.

15. A process for desulfurization of a hydrocarbon feedstock comprising:

a. supplying a hydrocarbon feedstock to an oxidation reactor, the hydrocarbon feedstock comprising a mixture of hydrocarbon compounds and a mixture of sulfur-containing hydrocarbon compounds;

b. contacting the hydrocarbon feedstock with an oxidant in the presence of a catalyst in the oxidation reactor under conditions sufficient to selectively oxidize sulfur-containing hydrocarbon compounds present in the hydrocarbon feedstock to produce an oxidation reactor effluent including the mixture of hydrocarbon compounds and a mixture of oxidized sulfur-containing hydrocarbon compounds;

c. passing the oxidation reactor effluent to an extraction zone for contacted with an extraction solvent to produce a desulfurized hydrocarbon product stream and an oxidized sulfur-containing hydrocarbon stream;

d. electrochemically reacting the oxidized sulfur-containing hydrocarbon stream in an electrochemical reactor in the presence of an effective amount electrolyte solution, the electrochemical reaction occurring under an electrical potential effective to promote decomposition of at least a portion of the oxidized sulfur-containing hydrocarbon compounds into a desulfurized effluent containing a mixture of sulfur-free hydrocarbons and sulfur byproduct, wherein the electrochemical reaction occurs at a temperature from about 20° C. to about 350° C., at a pressure of about 3 $kg/cm^2$ to about 30 $kg/cm^2$, and at a liquid hourly space velocity of about 0.05 $h^{-1}$ to about 4.0 $h^{-1}$, and wherein the electrolyte solution comprises an electrolyte salt in an organic solvent, and wherein the organic solvent is selected from the group consisting of ethylene carbonate, propylene carbonate, nitrobenzene, benzonitrile, N-formyl morpholine, sulfolane and mixtures including at least one of the foregoing solvents;

e. mixing the desulfurized effluent with water; and f. separating the mixture water and desulfurized effluent into sulfur-free hydrocarbons and a water/salt stream containing sulfur byproduct.

16. The process as in claim 15, wherein the oxidized sulfur-containing hydrocarbon compounds include sulfones and/or sulfoxides.

17. The process according to claim 15, wherein the hydrocarbon feedstock is a gasoline, diesel fuel, or kerosene fraction.

18. The process according to claim 15, wherein the oxidized sulfur-containing hydrocarbon compounds include DBT sulfone and one or more alkyl substituted DBT sulfones selected from 4-MDBT sulfone, 4,6-DMDBT sulfone, 1,4-DMDBT sulfone, 1,3-DMDBT sulfone, TriMDBT sulfone, TriEDBT sulfone, or C3DBT sulfone.

19. The process according to claim 15, wherein the hydrocarbon feedstock is derived from naturally occurring fossil fuels such as crude oil, shale oils, coal liquids, intermediate refinery products or their distillation fractions such as naphtha, gas oil, vacuum gas oil or vacuum residue or combination thereof.

20. The process according to claim 15, wherein the hydrocarbon feedstock is a fraction of an oxidized effluent from a hydrodesulfurization zone boiling above a cut point in the range of from 320-360° C.

* * * * *